United States Patent [19]

Sheldon et al.

[11] 4,163,401

[45] Aug. 7, 1979

[54] ELECTRO-HYDRAULIC INTERFACE FOR A POWER TONGS

[75] Inventors: Loren B. Sheldon; Robert R. Kelly, both of Houston, Tex.

[73] Assignee: B. J. Hughes Inc., Houston, Tex.

[21] Appl. No.: 777,672

[22] Filed: Mar. 15, 1977

[51] Int. Cl.[2] ..... B25B 13/50

[52] U.S. Cl. ..... 81/57.34; 81/57.35; 91/32; 137/596.17

[58] Field of Search ..... 81/57.15–57.24, 81/57.34, 57.35; 91/32, 33, 445; 137/596.17, 637.1, 870

[56] References Cited

U.S. PATENT DOCUMENTS

| | | | |
|---|---|---|---|
| 2,652,812 | 9/1953 | Fenzl | 91/32 |
| 3,881,375 | 5/1975 | Kelly | 81/57.35 |

*Primary Examiner*—Gerald A. Michalsky

*Attorney, Agent, or Firm*—Arnold, White & Durkee

[57] ABSTRACT

A manually operable valve in a power tongs assembly has, in combination therewith, an electro-hydraulic interface module. The interface module comprises an electrically responsive solenoid valve connected in hydraulically parallel path to the manually operated valve. The manually operated valve may be selectively disenabled and the electrically responsive valve simultaneously enabled to permit electrical control of the power tongs assembly.

4 Claims, 2 Drawing Figures

EXTEND STABBER
1042
1041
STABBER
1021
STABBER NOT EXTENDED
1020
1054
1009
1001
1045
TONGS IN STAND BY OR ABOVE
1046
1004
1003
1047
TONGS IN STORAGE
1048
1002
53
1000
1008
1052
BACK UP OPEN
1051
1007
1059
1014
1049
1006
1050
1005
1010
1057
1026
1025
1060
JOINT SENSED
1058
SENSOR RETRACTED
BACK UP CLOSED
1019
1017
1055
1056
TORQUED UP
1043
1044
EXTEND SENSOR
SENSOR
1027
1018
TONG
1028D
1039
TONG MAKE
1040
TONG BREAK
1033
TONG
SUPPLY
1015
BACKUP
1028C
1032
BACKUP
SUPPLY
1038
CLOSE BACKUP
1012
LIFT SPEED
1028B
1031
LIFT SPEED
SUPPLY
1013
1037
LIFT SPEED
1011
1028A
LIFT
1030
LIFT
SUPPLY
LIFT UP
1035
LIFT DOWN
1036

ELECTRO-HYDRAULIC INTERFACE FOR A POWER TONGS

CROSS-REFERENCE TO RELATED APPLICATIONS

Subject matter disclosed and claimed herein is disclosed in the following copending applications, each assigned to the Assignee of the present invention:

Computer-Controlled Oil Drilling Rig Having Drawworks Motor and Brake Control Arrangement, Ser. No. 777,724, filed Mar. 15, 1977 in the names of James P. Heffernan, Loren B. Sheldon, James R. Tomashek, and Donald H. Ward; and, Power Tongs Control Arrangement, Ser. No. 777,926, filed Mar. 15, 1977 in the names of Loren B. Sheldon, James R. Tomashek and Donald H. Ward.

BACKGROUND OF THE INVENTION

1. Field of the Invention

This invention relates to an interface assembly in a power tongs for selectively disenabling a manually operable valve and for enabling an electrically responsive valve.

2. Description of the Prior Art

Manually operable power tongs to effect the making and breaking of joints between elements of a drill string are known in the art. The tongs manual control console usually is provided with four levers, each of which controls a pilot valve of a small four-section stack valve. Each pilot valve controls one main function of the commonly utilized tongs structure.

For example, one valve controls the opening and closing of the backup tong. A second valve controls the tongs motor to rotate the power driven tong. The lift speed of the tongs is controlled by a third valve, while a fourth valve controls the upward or downward movement of the tongs lift. Of course, other tongs functions as, for example, the extension of the stabber (if one is provided) or the extension of a joint sensor would require a manual valve for the operation of each.

It would be advantageous to automatically control a power tongs arrangement by utilization of an electrical tongs control system. However, if an electrical control system is utilized, it is necessary to provide a suitable electro-hydraulic interface to permit valves which are manually operable to be operable in response to electrical signals output from the control system. To locate the power driven and backup tong in a predetermined operating relationship with respect to the tool joint, a joint sensor arrangement is advantageously utilized.

SUMMARY OF THE INVENTION

This invention relates to an electro-hydraulic interface module for a power tongs assembly. The module is disposed in cooperative association with a manually operated valve. The module includes an electrically responsive solenoid valve connectable in parallel relationship to the manually operated valve. The electrically operated valve performs the same function as that provided for the tongs assembly by the manually operated valve. Means, such as select valve switches, are provided to selectively enable the electrically responsive valve and to simultaneously disenable the manual control valve.

BRIEF DESCRIPTION OF THE DRAWINGS

The invention will be more fully understood from the following detailed description of the preferred embodiment thereof, taken in connection with accompanying drawings, which form part of this specification, and in which.

DESCRIPTION OF THE PREFERRED EMBODIMENT

Figure 1:
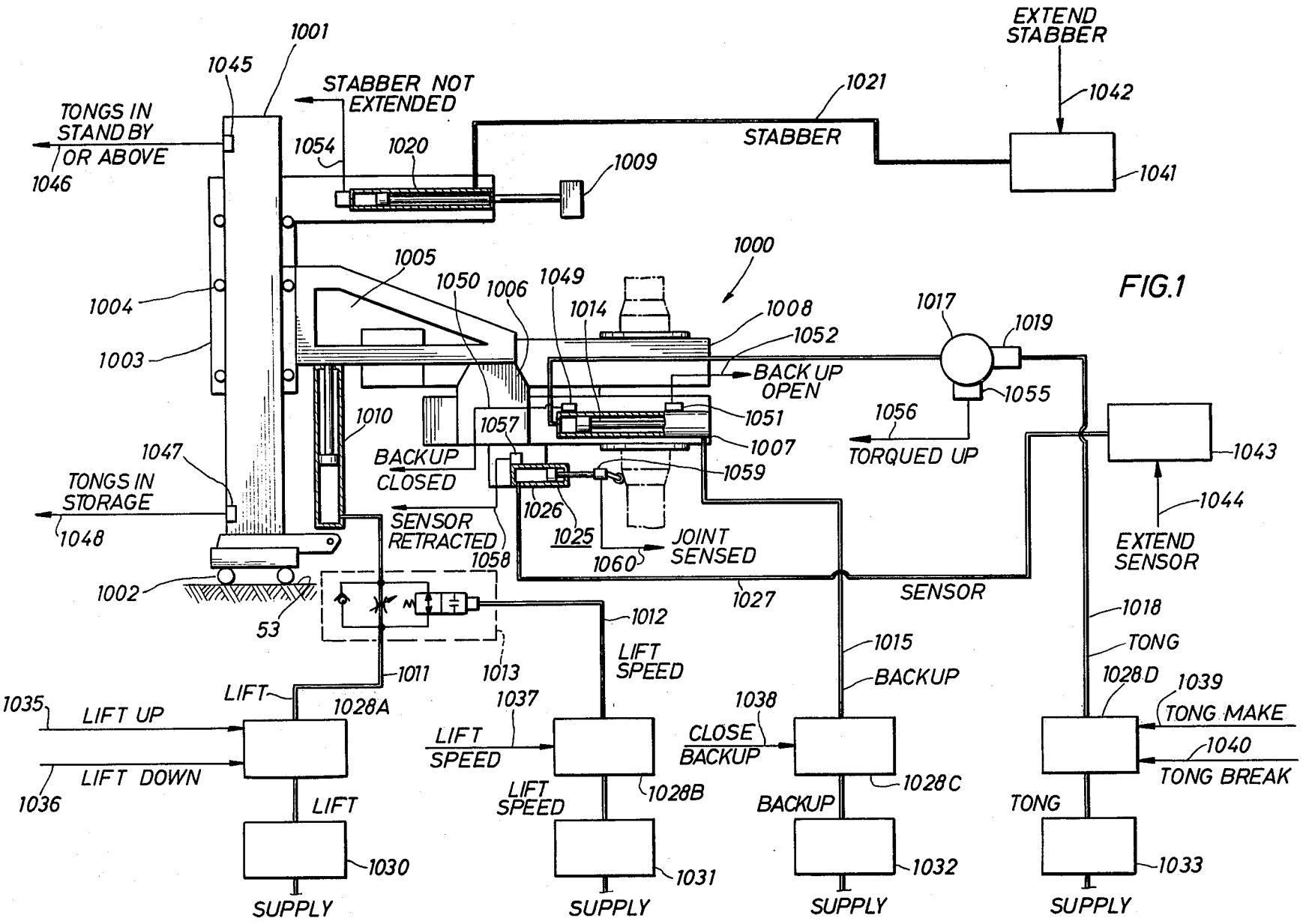
FIG. 1 is a highly stylized pictorial representation of a power tongs assembly illustrating conventional tongs elements and elements associated therewith according to this invention; and, FIG. 2 is a detailed schematic diagram of an electro-hydraulic interface embodying the teachings of this invention and disposed in a power tongs assembly in accordance with FIG. 1.

Throughout the following description, similar reference numerals refer to similar elements in all Figures of the drawings.

Power tongs for making and breaking joints between a pipe stand and a drill string are well-known in the art. For example, U.S. Pat. No. 3,881,375, issued to Robert R. Kelly and assigned to the Assignee of the present invention, discloses the basic structure of a power tongs assembly. In FIG. 1, shown is a highly stylized pictorial representation of a power tongs assembly 1000. FIG. 1 illustrates the main structural elements common to all power tongs assemblies and also diagrammatically illustrates additional structural elements provided in accordance with this invention.

The tongs assembly 1000 is located adjacent to the slips provided on the floor of the derrick. As is typical and well-known to the art, the tongs 1000 are mounted on a vertical column 1001, itself mounted on bearings 1002 to permit the tongs 1000 to swing into and out of alignment with the bore being generated. A collar 1003 is mounted, as by rollers 1004, for movement along the vertical column 1001. A tongs supporting yoke 1005 is mounted to the collar 1003 and projects horizontally therefrom. The yoke 1005 supports a cradle 1006 in which a backup tong 1007 and a power driven tong 1008 are disposed. The backup tong 1007 is adapted to hold one (usually the lower) section of the pipe sections defining the joint to be made-up or broken-out against rotation while the driven tong engages the other section to rotate the same in a predetermined direction. The direction of rotation depends upon whether the joint is being made-up or broken-out.

Also mounted on the column 1001 in any suitable relationship thereto (shown in FIG. 1 as being in cooperative association with the collar 1003) is a stabber 1009. As is well-known to those skilled in the art, the stabber 1009 may or may not be provided in a conventional tongs assembly, but if it is so provided, the stabber 1009 is operative to assist in locating or "stabbing" the next pipe stand to be added to the drill string during a make-up cycle. Since the structures discussed are conventional, it is understood that any suitable configuration of elements exhibiting these functions and operating to effect the make-up or break-out of a joint in the drill string may be controlled by a control system embodying the teachings of abovementioned copending applications.

As is also conventional in the art, a tongs lifting arrangement 1010 is provided. The arrangement 1010 comprises means for lifting the tongs from a lower, or storage, position to an upper, or standby, position and, past the standby position to a still-further upward operating position. Any suitable means may be utilized, as illustrated by the piston-cylinder arrangement associated with a chain drive. Fluid, such as pressurized hydraulic oil, for controlling the lifting and lowering motion of the tongs is conducted from a fluid supply to the piston-cylinder arrangement 1010 on a fluid line 1011. The speed at which the tongs are raised from the storage to the standby positions and from the standby to the operating positions is regulated by the fluid in a line 1012 having a restrictor 1013 therein.

Included within the backup tong 1007 is means 1014, such as a piston-cylinder arrangement, for opening and closing the backup tong 1007. Fluid, such as pressurized hydraulic oil, for operating the piston-cylinder arrangement 1014 is conducted thereto in a line 1015. Similarly, means 1017, such as a tongs motor, is provided in operative association with the driven tong 1008 for opening and closing the jaws of the power driven tong and for rotating the power driven tong 1008 in a predetermined direction to effect the make-up or break-out of the joint. Fluid for operating the tongs motor 1017 is carried in a line 1018 to a cylinder 1019 related thereto. Means 1020, such as a piston-cylinder arrangement, is associated with the stabber 1009 for controlling the extension thereof. Fluid, such as pressurized air, utilized to energize the piston-cylinder 1020 is conducted thereto in a line 1021. Each of these above means for lifting the tongs at a predetermind lift speed, for opening and closing the backup tong, for closing the tongs motor jaws and rotating the same, and for extending the stabber, are conventional in the art and any arrangement to accomplish the recited functions may be made compatible with the control system embodying the teachings of the invention disclosed and claimed in the referenced copending applications.

The tongs 1000 embodying the teachings of this invention also includes a joint sensor arrangement 1025. A suitable joint sensor 1025 is disclosed and claimed in the copending application of Loren B. Sheldon, Ser. No. 777,673, filed Mar. 15, 1977, and assigned to the Assignee of the present invention. The sensor 1025 comprises a sensor arrangement having a pivotally mounted roller arm with limit switch associated therewith such that deflection of the arm by a predetermined portion of a drill pipe (as, for example, the box end taper) actuates the limit switch. When the limit switch is actuated, it is then known that a predetermined location on the drill pipe has been reached by the roller. Further, due to the standardization of drill pipes for oil drilling work, it is also known that any other feature of the pipe, such as the joint itself, is then a predetermined known distance from the location of the feature on the pipe which energized the limit switch.

The joint sensor 1025 included means 1026, such as a piston-cylinder arrangement, for extending the sensor to contact the pipe. Fluid such as pressurized air to actuate the extension means 1026 is carried by a line 1027.

In a conventional arrangement, a manually operated valve 1030 is disposed in association with the fluid line 1011 (LIFT) to regulate the flow of fluid therein. The valve 1030 is usually operable in two directions to energize the lift means 1010 for upward or downward movement of the tongs along the vertical column 1001. A manual valve 1031 is associated with the fluid line 1012 (LIFT SPEED) and is manually operable to adjust the speed at which the tongs are raised. Usually, the speed is variable from a first, normal, speed exhibited during movement of the tongs from the storage to the standby positions, to a second, slower, speed exhibited during movement of the tongs from the standby to the operating positions, during which times the sensor is extended to sense the joint.

A manually operated valve 1032 is associated with the hydraulic line 1015 (BACKUP) to regulate the flow of hydraulic fluid therein to the backup tong 1007. Manual actuation of the valve 1032 controls the opening or closing of the backup tong 1007, as is appreciated by those skilled in the art. A valve 1033 is associated with the fluid line 1018 (TONG) connected to the tongs motor 1017 to control the opening and closing of the power driven tong 1008 and the rotation thereof. The valve 1033 is similar to the valve 1030 and is a two-direction manual valve which in one position operates the tongs motor 1017 to make up a drill string while in the other position operates the tongs motor 1017 to break out a joint in the drilling string.

If a stabber 1020 is utilized, a manual valve may be provided therefor operative to control passage of fluid in the lines 1021 (STABBER) to extend or retract the stabber. Further, it would be appreciated by those skilled in the art if a joint sensor 1025 embodying the teachings of this invention is utilized in a manual tongs assembly, the extension of the joint sensor may be manually effected through the provision of an appropriate manual valve regulating the flow of fluid such as pressurized air in the lines 1027 (SENSOR) to control the extension and retraction thereof.

Since, in the conventional arrangement above-described (with the exception of the joint sensor 1025), the control of the tongs structure is effected by the manual manipulation of valves in the fluid lines, it would be advantageous to provide an automated electronic control system, such as that disclosed in the above-mentioned copending application, to electronically operate the tongs structure. However, since the outputs of the control system there-disclosed are electrical control signals, and since the above-discussed conventional tongs assembly utilizes fluid energized operators, it is necessary to provide an electro-hydraulic interface (E.H.I.) module embodying the teachings of this invention intermediate the tongs control system and the tongs structure controlled thereby. This module is illustrated diagrammatically in FIG. 1 and discussed in complete detail in connection with FIG. 2. Each interface module is generally indicated by reference numeral 1028 and is provided to disenable the manually operated valve with which it is associated and to substitute therefore an electrically responsive valve adaptable to be controlled by the electrical output signals from a tongs control system. A suitable tongs control system for use in conjunction with the present invention is the control system as disclosed and claimed in the referenced copending application of Loren B. Sheldon et al., Ser. No. 777,926. That system is operative to output enabling signals to electrically responsive valve elements to initiate and automatically control the various operations of the power tongs. Of course, any suitable control system which outputs appropriate electrical control signals may be used in connection with the present invention.

In general, the interface module 1028 includes an electrically operated solenoid valve connected in parallel relationship with the manually operated valve and in the same cooperative relationship with the fluid line through which the structure of the tongs communicates with the sources of fluid therefor. Further, each interface module includes means for selectively enabling the electrically operated valve and simultaneously disenabling the manual valve. The select means can conveniently be an electrically or manually operable switch arrangement, or any other suitable arrangement. Thus, dependent upon the operative mode (automatic or manual) selected, either the electrically operated valve or the manually operated valve will be determinative as to the passage of hydraulic fluid in the lines with which it is associated.

As seen in FIG. 1, four interface modules 1028A, 1028B, 1028C and 1028D are provided so as to make the above-described conventional system responsive to the electrical signal outputs from the tongs control system. (Of course, if a conventional system utilized other manually operated valves, an interface module could be provided to make the function provided by that manually-operated valve electrically controllable.) The interface module 1028A (LIFT) is associated with the fluid line 1011 and controls movement of the tongs 1000 in a vertically upward and vertically downward direction. Since the manually operated valve 1030 with which the interface 1028A is associated is a four-way valve, the electrically responsive valve connected in parallel relationship to the valve 1030 within the interface 1028A is similarly a four-way valve. Therefore, electrical lines 1035 (LIFT UP) and 1036 (LIFT DOWN) are input to the interface module 1028A from the tongs control system. The presence of a signal on the appropriate line 1035 (LIFT UP) or 1036 (LIFT DOWN) from the tongs control system initiates, respectively, an upward lifting movement of the tongs 1000 and a downward movement thereof.

The interface module 1028B is associated with the manually operated valve 1031 and includes a valve connected in parallel relationship thereto which is responsive to an electrical signal on an electrical line 1037 (LIFT SPEED) to control the rate at which upward speed of the tongs 1000 is effected. The interface module 1028C includes a valve connected in parallel relationship with the manually operated valve 1032, the interface valve being responsive to a signal on an electrical line 1038 (BACKUP) from the tongs control system. Energization of the line 1038 with the manual valve 1032 disenabled actuates the electrically responsive valve within the interface module 1028C to effect the closing of the backup tong 1007. Interface module 1028D includes an electrically responsive valve connected in parallel relationship with the manually operated valve 1033 and is actuable to control fluid flow to the tongs motor 1017 to make-up or break-out a joint. Since the manually operated valve 1033 is operable in two-directions, the electrically responsive valve within the interface module 1028D is responsive to signals from the tongs control system on electrical lines 1039 (TONG MAKE) or 1040 (TONG BREAK) to respectively initiate motion of the tong motor 1017 to drive the driven tong 1008 to make-up or break-out the joint. It is understood that if other manual control valves are provided in a particular manually operated tongs assembly, suitable interfaces embodying the teachings of this invention may be provided to automate the functions performed thereby and make control thereof possible by the use of the tongs control system embodying the teachings of the referenced copending applications.

A four-way, single solenoid, electrically responsive valve 1041 responds to an electrical signal on a line 1042 (EXTEND STABBER) from the tongs control system to control the passage of fluid in the line 1021 to actuate the piston-cylinder arrangement 1020 to extend or retract the stabber 1009. A four-way single solenoid, spring offset, electrically responsive valve 1043 responds to an electrical signal from the tongs control system on a line 1044 (EXTEND SENSOR) to actuate the piston-cylinder arrangement or other suitable extension means 1026 disposed within the joint sensor 1025. It is, of course, understood that if either of these last two functions were provided by a manually operated control valve in a particular manually operated tongs assembly, a suitable interface module would be provided to disenable the manually operated valve and selectively enable the electrically responsive valve to permit automated control of the tongs assembly by a control system embodying the teachings of the copending applications.

Figure 2:
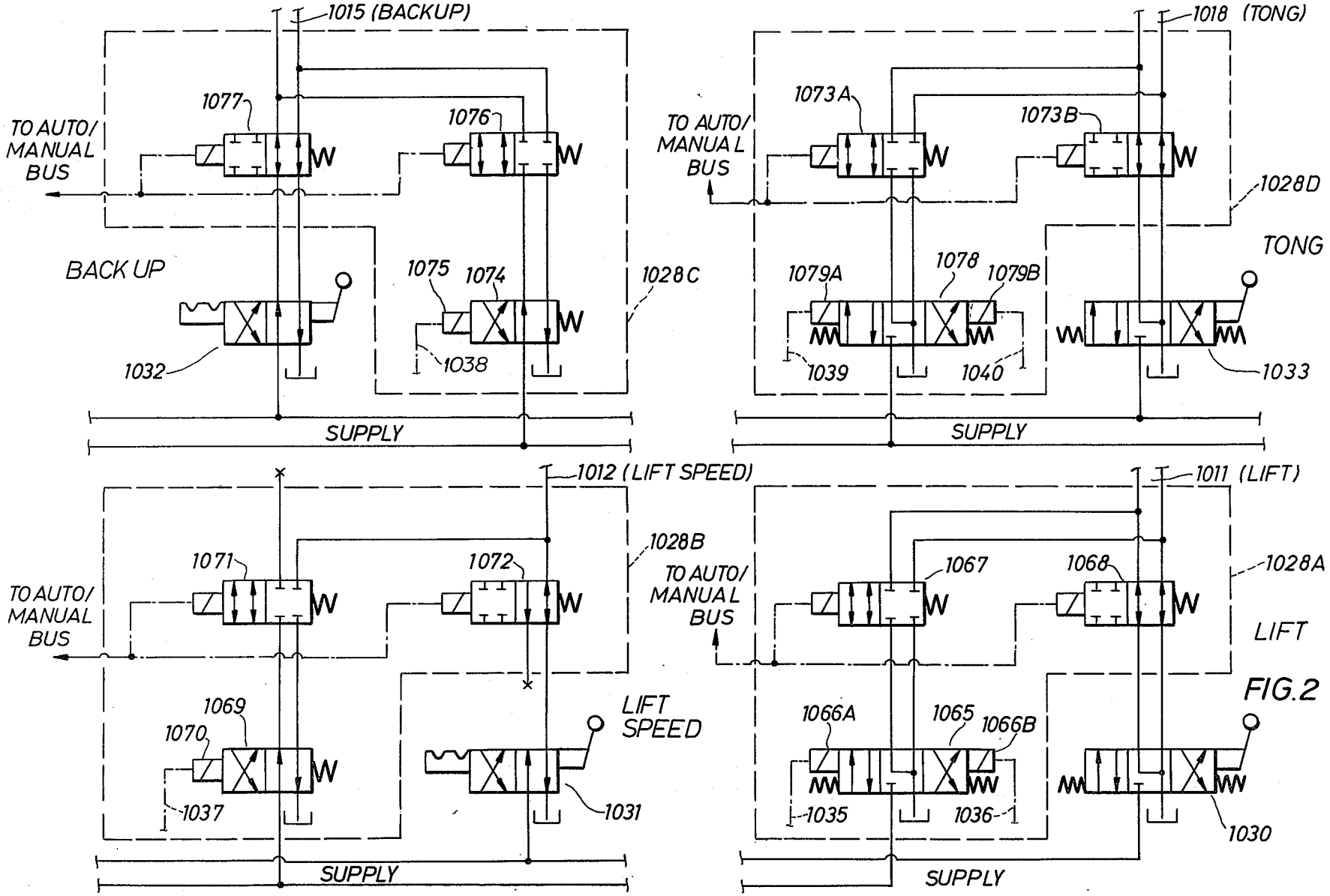

Referring now to FIG. 2, a detailed schematic diagram of each of the interface modules 1028A through 1028D in shown. Each of the interface modules 1028 includes an electrically responsive solenoid valve adapted to control the flow of hydraulic fluid from a supply, or source, thereof to the respective user apparatus with which the interface module is associated. Whether the manually operated valve (and, therefore, the electrically responsive valve disposed within each interface) is a pilot valve (in the sense of initiating the operation of a larger valve) or is a control valve (in the sense of interdicting the flow of hydraulic fluid) is a design consideration dependent upon the particularities of a given tongs system. The electro-hydraulic interface module is an adjunct to the tongs control system and is adapted to disenable the manually operated valve and replace it with an electrically responsive valve which performs the same function as performed by the manually operated valve.

Thus, if the manually operated valve were a pilot valve, the electrically responsive valve in the interface would assume a pilot valve function. Alternatively, if the manually operated valve were a control valve, the electrically operated valve in the module would assume a control valve function. The electrically operated valve is connected in a parallel flow path to the manually operated valve. Further, each interface module 1028A through 1028D includes means, such as a select valve switch, disposed in series with the electrically responsive valve and with the manually operated valve to simultaneously disenable one of the valves and enable the other of the valves. The select valve switches may be manually or electrically operated and are illustrated as electrically operated in connection with FIG. 2.

The select valves or switches are all energized by the same source, namely an AUTO/MANUAL BUS from the tongs control system. The manual valves are enabled whenever the AUTO/MANUAL BUS is deenergized and the electrically responsive valves are disenabled. The electrically responsive valves are enabled when the AUTO/MANUAL BUS is energized to simultaneously energize all select valves.

As seen in the schematic diagram of the interface module 1028A, the four-way manually operated valve 1030 with which the module is associated is also illustrated.

An electrically responsive, four-way solenoid valve 1065, connected in parallel relationship with the manually operated valve 1030, has solenoid coils 1066A and 1066B asssociated therewith. Connected in series with the electrically responsive valve 1065 is an AUTO-MANUAL SELECT valve switch 1067, while connected in series to the manually operated valve 1030 is an AUTO-MANUAL SELECT valve switch 1068. Actuation of all of the select valve switches simultaneously enables either the electrically responsive or manually operated valves and simultaneously disenables the other. The solenoid coil 1066A is connected to the electrical line 1035 (LIFT UP) from the tongs control system while the solenoid coil 1066B is connected to the electrical line 1036 (LIFT DOWN) from the tongs control system. The presence of a signal in the line 1035 (LIFT UP) energizes the coil 1066A and lifts the tongs from the storage to the standby position. Analogously, the presence of a signal on the line 1036 (LIFT DOWN) energizes the coil 1066B and lowers the tongs from the standby to the storage position.

The interface module 1028B is associated with the manually operated valve 1031. An electrically responsive solenoid valve 1069 is connected in a parallel hydraulic path to the manually operated valve 1031. The valve 1069 has a solenoid coil 1070 associated therewith. AUTO/MANUAL SELECT valve switches 1071 and 1072 are, respectively, connected in series with the electrically responsive solenoid valve 1069 and the manually operated valve 1031 for purposes analogous to those discussed in connection with the select valve switches 1067 and 1068. The solenoid coil 1070 of the electrically responsive valve 1069 is connected to the electrical line 1037 (LIFT SPEED) output from the tongs control system. If the select valve switches 1071 and 1072 are disposed so as to simultaneously disenable the manually operated valve 1031 and enable the electrically responsive valve 1069, the presence of a signal in the line 1037 (LIFT SPEED) actuates the valve 1069 to regulate the speed at which the tongs are lifted from a first to a second elevation.

The interface module 1028C operates exactly as the structure described in connection with the module 1028B. An electrically responsive valve 1074 having a solenoid coil 1075 attached thereto is connected in a parallel hydraulic path to the manually operated valve 1032. AUTO/MANUAL SELECT valve switches 1076 and 1077 are respectively connected in series with the electrically responsive valve 1074 and the manually operated valve 1032. The solenoid 1075 is connected to the electrical line 1038 (BACKUP) from the tongs control system. If the select valve switches 1076 and 1077 are disposed so as to disenable the manually operated valve 1032 and to simultaneously enable the electrically responsive valve 1074, the presence of a signal on the line 1038 (BACKUP) from the tongs control system actuates the valve 1074 to close the backup tong 1007.

The interface module 1028D is similar in configuration to that discussed in connection with the interface module 1028A. That is to say, a four-way, electrically responsive, solenoid valve 1078 having first and second solenoid coils 1079A and 1079B associated therewith is connected in a parallel hydraulic path to the four-way manually operated valve 1033. AUTO/MANUAL SELECT valve switches 1073A and 1073B are respectively connected in series to the electrically responsive valve 1078 and the manually operated valve 1033. The solenoid 1079A is connected to the line 1039 (TONG MAKE) from the tongs control system while the solenoid 1079B is connected to the line 1040 (TONG BREAK) output therefrom. If the select valve switches 1073A and 1073B were disposed so as to simultaneously disenable the manually operated valve 1033 and enable the electrically responsive valve 1078, the presence of a signal on the line 1039 (TONG MAKE) actuates the electrically responsive valve 1078 to enable the tongs motor 1017 to make-up a joint of a drill string. The presence of a signal on the line 1040 (TONG BREAK) from the tongs control system actuates the solenoid 1079B and energizes the tongs motor 1017 to break-out a drill string joint.

Since each of the four interface modules 1028 have substantially the same internal hydraulic circuitry and utilize substantially similar type values, the same supply manifold may be utilized to reduce cost and provide a symmetrical electro-to-hydraulic interface assembly. The interface modules may be mounted on a common base and connected to common pressure and tank manifolds. A pressure-reducing valve and accumulator may, of course, be included to supply a constant pressure. Suitable hydraulic line tubing may be used to connect the valve manifolds and pressure-reducing valve to the common manifolds and to the input and output header plates of the electro-to-hydraulic interface.

Having described a preferred embodiment of the invention, modifications may be made thereto without departing from the scope of the invention.

What is claimed is:

1. In a power tongs arrangement including a backup tong and a driven tong, each tong having a fluid line adapted to supply a pressurized driving fluid thereto, a first and a second manually operable flow control valve respectively connected within the fluid line to the backup tong and to the driven tong to manually control fluid flow thereto, wherein the improvement comprises:

a first and a second electrically responsive solenoid valve respectively connected into the fluid line to the backup tong and to the driven tong in parallel relationship with the manually operable valve disposed therein, each electrically responsive solenoid valve adapted to control fluid flow through its associated line in response to a predetermined electrical signal;

a first and a second electrically responsive select valve respectively connected in series with the first and the second manually operable valves and adapted, when energized, to disenable the fluid flow control capability of the first and the second manually operable valves;

a third and a fourth electrically responsive select valve respectively connected in series with said first and said second electrically responsive solenoid valves and adapted, when energized, to enable the fluid flow control capability of said first and said second electrically responsive solenoid valves, said first and said second select valves being isolated from communication with said third and fourth select valves; and, means for simultaneously energizing all of said select valves to simultaneously disenable the first and the second manually operable valves and simultaneously enable said first and said second electrically responsive solenoid valves to thereby render the flow of fluid to the backup tong and to the driven tong susceptible to control in response to a predetermined electrical signal.

2. The power tongs arrangement of claim 1, further including means for lifting the backup and driven tong, the lift means having a fluid line adapted to supply a pressurized driving fluid thereto, a third manually operable flow control device connected within the fluid line to the lifting means to manually control fluid flow thereto, wherein the improvement further comprises:

a third electrically responsive solenoid valve connected into the fluid line to the lifting means in parallel relationship with the manually operable valve disposed therein to control fluid flow therethrough in response to a predetermined electrical signal;

a fifth electrically responsive select valve connected in series with the third manually operable valve and adapted, when energized, to disenable the fluid flow control capability of the third manually operable valve;

a sixth electrically responsive select valve connected in series with said third electrically responsive solenoid valve and adapted, when energized, to enable the fluid flow control capability of said third electrically responsive solenoid valve, said fifth select valve and said sixth select valve being isolated from communication one with the other; and, means for energizing said fifth and said sixth select valves simultaneously with said first, second, third and fourth select valves to disenable the third manually operable valve and simultaneously enable said third electrically responsive solenoid valve to thereby render the flow of fluid to the lifting means susceptible to control in response to a predetermined electrical signal.

3. In a power driven tongs including a backup tong and a driven tong, each of said tongs operatively connected to a line for the supply of pressurized fluid thereto, each said line having (a) means for manually controlling the flow of fluid to the tong to which the line is connected, and (b) solenoid valve means therein for selectively opening and closing said line in response to predetermined electrical signals, electrically actuated first select means operatively connected to each of said manual control means for closing the latter against fluid flow, electrically actuated second select means operatively connected to each of said solenoid valve means for opening the latter for fluid flow therethrough, said first and second select means being isolated against communication therebetween, and means for simultaneously energizing all said first and second select means for simultaneous opening of said solenoid valve means and closing of said manual control means to thereby convert said backup tong and said driven tong from manually to electrically actuated operation.

4. In a power driven tongs including a backup tong and a driven tong, each of the tongs operatively connected to a line for the supply of pressurized fluid thereto, each line having a manually operable valve for controlling the flow of fluid to the tong to which the line is connected, an electro-hydraulic interface module for each line comprising:

an electrically responsive solenoid valve connected in parallel to the manually operable valve;

means for selectively enabling the electrically responsive valve and simultaneously disenabling the manually operable valve, the means including first and second electrically responsive select valves respectively connected to the manually operable valve and to the electrically responsive solenoid valve, the select valves being isolated against communication therebetween; and, means for simultaneously energizing the first and the second select valves to simultaneously disenable the flow control capability of the manually operable valve and enable the flow control capability of the electrically responsive valve to thereby render the fluid flow in the line susceptible to control by the electrically responsive solenoid valve in response to a predetermined electrical signal.

* * * * *